US012714157B2

(12) United States Patent
Youn

(10) Patent No.: US 12,714,157 B2
(45) Date of Patent: Aug. 25, 2026

(54) BRASSIERE FOR BREAST SURGERY PATIENT

(71) Applicant: Antigravity Co., Ltd., Seoul (KR)

(72) Inventor: Bongkeun Youn, Seoul (KR)

(73) Assignee: Antigravity Co., Ltd., Seoul (KR)

( * ) Notice: Subject to any disclaimer, the term of this patent is extended or adjusted under 35 U.S.C. 154(b) by 0 days.

(21) Appl. No.: 19/207,808

(22) Filed: May 14, 2025

(65) Prior Publication Data

US 2026/0232048 A1 Aug. 13, 2026

(30) Foreign Application Priority Data

Feb. 7, 2025 (KR) ..... 10-2025-0015765

(51) Int. Cl.
*A41C 3/00* (2006.01)

(52) U.S. Cl.
CPC ..... *A41C 3/0064* (2013.01)

(58) Field of Classification Search
CPC ..... A41C 3/04; A41C 3/0071; A41C 3/0092; A41C 3/12
USPC ..... 450/1
See application file for complete search history.

(56) References Cited

U.S. PATENT DOCUMENTS 6,319,092 B1 * 11/2001 Leyhe ..... A41C 3/0071 450/36
6,645,041 B2 * 11/2003 Sørensen ..... D04B 1/246 2/104
10,881,155 B2 * 1/2021 Hoth ..... A41C 3/08
2013/0273809 A1 * 10/2013 Turk ..... A41C 3/0071 450/36
2016/0106159 A1 * 4/2016 Yau ..... A41C 3/04 450/36
2017/0055602 A1 * 3/2017 Abraham ..... A41C 3/0057
2021/0145633 A1 * 5/2021 Fabian ..... A61F 7/007

* cited by examiner

*Primary Examiner* — Timothy K Trieu
(74) *Attorney, Agent, or Firm* — Studebaker Brackett PLLC

(57) ABSTRACT

A brassiere for a breast surgery patient is provided. The brassiere for a breast surgery patient includes a brassiere body that has a pair of breast holes through which breasts of a user pass and is worn to surround a chest part, to prevent a pain in an incision portion and effectively prevent a random movement of a prosthesis inserted into the breast while the user may wear the brassiere without compressing the operated breast and a main reinforcing band coupled to the brassiere body to pass through a lower side and an outer side adjacent to the breast holes, wherein the main reinforcing band is made of a soft material and formed in a band shape.

4 Claims, 9 Drawing Sheets

430

BRASSIERE FOR BREAST SURGERY PATIENT

CROSS-REFERENCE TO RELATED APPLICATIONS

A claim for priority under 35 U.S.C. § 119 is made to Korean Patent Application No. 10-2025-0015765 filed on Feb. 7, 2025, in the Korean Intellectual Property Office, the entire contents of which are hereby incorporated by reference.

BACKGROUND

Embodiments of the inventive concept described herein relate to a brassiere, and more particularly, relate to a brassiere for a breast surgery patient capable of preventing a random movement of a prosthesis inserted into a breast after breast enlargement surgery.

In general, breast enlargement surgery is performed to improve a size of a breast, and examples of the breast enlargement surgery include breast enlargement surgery using a prosthesis, breast enlargement surgery through autologous fat transplantation, and breast enlargement surgery using a filler product. Among them, the breast enlargement surgery, in which a prosthesis is inserted, is a surgery in which a prosthesis having about 200 g to 400 g is inserted into a breast, and even when the prosthesis is put in a correct position, the prosthesis may be moved downward or sideways through a soft tissue of a skin, and thus a correction brassiere is worn for a predetermined period of time after the surgery to prevent a change in a position of the prosthesis.

The brassiere according to the related art is a brassiere that does not compress a breast when a user wears the brassiere because a breast hole is formed to expose the breast in which the prosthesis is inserted, and an example of this brassiere is disclosed in Korean Patent Registration No. 10-2685802 (hereinafter, referred to as a "prior invention").

In the prior invention, the breast is configured to be exposed, the breast is not compressed, and a support including a wire is coupled to a band along an underline of the breast to support the exposed breast. In this way, the support including the wire compresses an incision portion to cause pain when a breast underline is cut to insert the prosthesis during the breast enlargement surgery, an upward convex phenomenon may occur due to upward pushing of the prosthesis, and thus a change in a shape of the operated breast may be caused.

Further, as in the prior invention, even when a user goes out wearing an outer garment while wearing the brassiere having the exposed breast, nipples become more prominent, and a pain is caused in the breast in which the surgery is performed depending on a material or an adhesion degree of the outer garment.

SUMMARY

The inventive concept provides a brassiere for a breast surgery patient, which may be worn without compressing an operated breast, may prevent pain in an incision portion, and may effectively prevent a random movement of prosthesis inserted into the breast.

The inventive concept also provides a brassiere for a breast surgery patient, which protects a breast from an outer garment when a user goes out to prevent pain and does not cause prominent nipples through clothes so that the user may not care about other people's attention.

The technical objects of the inventive concept are not limited to the above-mentioned ones, and the other unmentioned technical objects will become apparent to those skilled in the art from the following description.

According to an aspect of the inventive concept, there is provided a brassiere for a breast surgery patient includes a brassiere body in which a pair of breast holes are formed such that breasts of a user pass therethrough and which is worn to cover a chest part and a main reinforcing band coupled to the brassiere body to pass through a lower side and an outer side adjacent to the breast holes, wherein the brassiere body includes a front close contact part in which the pair of breast holes are formed and which extends upward from an upper side of each of the pair of breast holes to a central portion of a shoulder of the user while covering the chest part of the user, a rear fastening part which extends to both sides of the front close contact part and passes through a lower side of an armpit of the user and of which ends are fastened to each other at a back of the user, and a shoulder strap member that connects an upper end of the front close contact part and the rear fastening part and is hung on the shoulder of the user, and the main reinforcing band is made of a soft material and formed in a band shape, a central portion thereof passing through a lower side between the pair of breast holes extends upward toward a cleavage of the user, and the main reinforcing band is coupled to the front close contact part such that one end thereof is located at the upper end of the front close contact part located above the one breast hole and the other end thereof is located at the upper end of the front close contact part located above the other breast hole.

BRIEF DESCRIPTION OF THE FIGURES

The above and other objects and features will become apparent from the following description with reference to the following figures, wherein like reference numerals refer to like parts throughout the various figures unless otherwise specified, and wherein.

DETAILED DESCRIPTION

Figure 1:
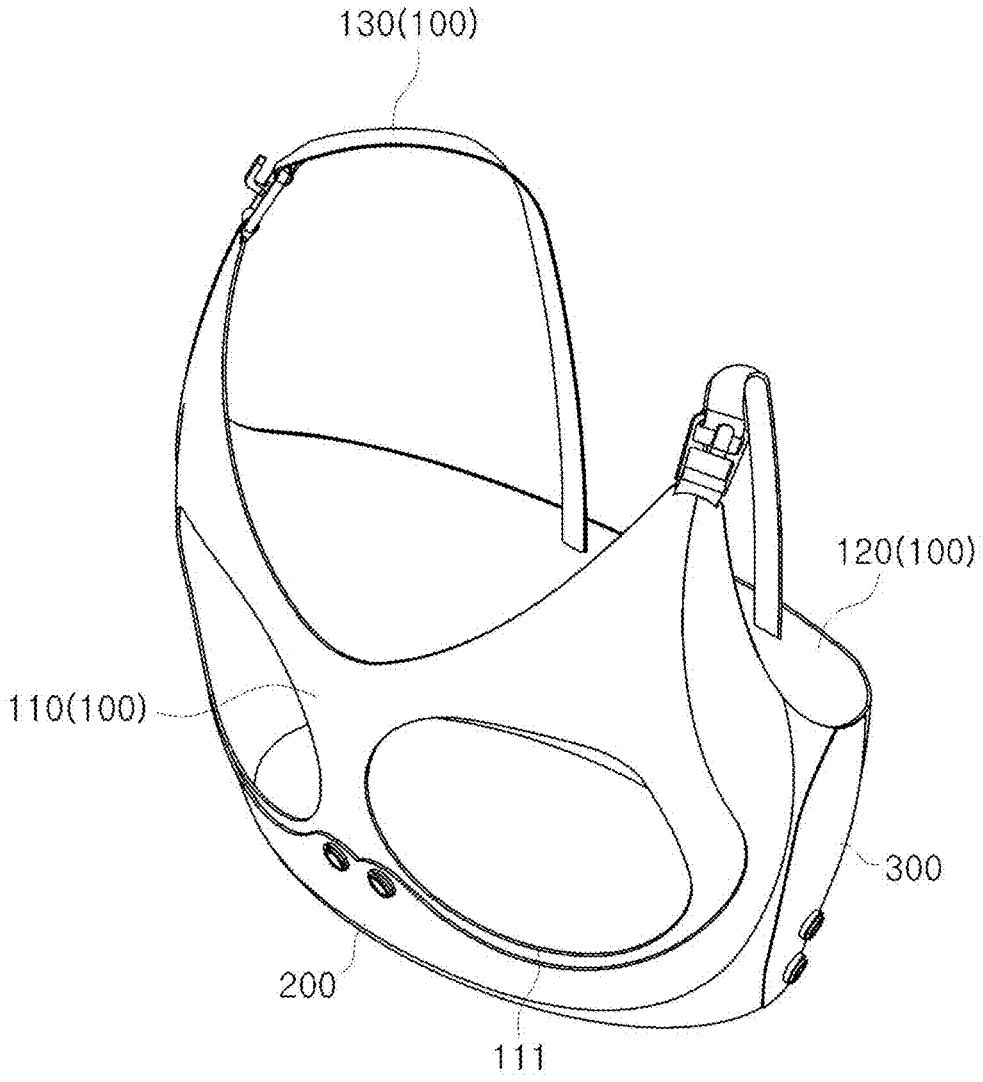
FIG. 1 is a perspective view illustrating a brassiere for a breast surgery patient according to an embodiment of the inventive concept.

The above and other aspects, features and advantages of the invention will become apparent from the following description of the following embodiments given in conjunction with the accompanying drawings. However, the inventive concept is not limited to the embodiments disclosed below, but may be implemented in various forms. The embodiments of the inventive concept are provided to make the disclosure of the inventive concept complete and fully inform those skilled in the art to which the inventive concept pertains of the scope of the inventive concept.

The terms used herein are provided to describe the embodiments but not to limit the inventive concept. In the specification, the singular forms include plural forms unless particularly mentioned. The terms "comprises" and/or "comprising" used herein does not exclude presence or addition of one or more other elements, in addition to the aforementioned elements. Throughout the specification, the same reference numerals dente the same elements, and "and/or" includes the respective elements and all combinations of the elements. Although "first", "second" and the like are used to describe various elements, the elements are not limited by the terms. The terms are used simply to distinguish one element from other elements. Accordingly, it is apparent that a first element mentioned in the following may be a second element without departing from the spirit of the inventive concept.

Unless otherwise defined, all terms (including technical and scientific terms) used herein have the same meaning as commonly understood by those skilled in the art to which the inventive concept pertains. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein.

Hereinafter, exemplary embodiments of the inventive concept will be described in detail with reference to the accompanying drawings.

Embodiments of the inventive concept propose a brassiere for a breast surgery patient, including a brassiere body that has a pair of breast holes through which breasts of a user pass and is worn to surround a chest part, to prevent a pain in an incision portion and effectively prevent a random movement of a prosthesis inserted into the breast while the user may wear the brassiere without compressing the operated breast and a main reinforcing band coupled to the brassiere body to pass through a lower side and an outer side adjacent to the breast holes, wherein the main reinforcing band is made of a soft material and formed in a band shape.

Figure 2A:
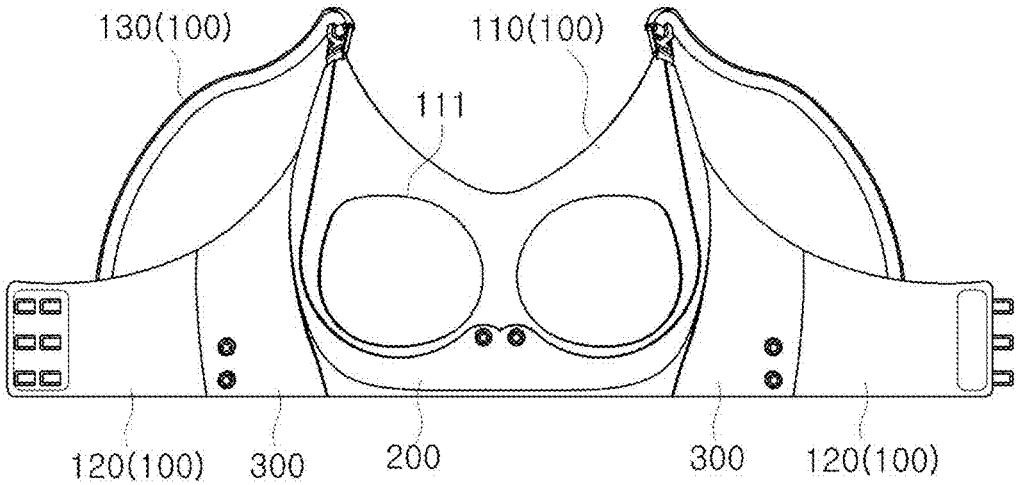
FIGS. 2A-2B are a front view and a rear view illustrating the brassiere for a breast surgery patient according to the embodiment of the inventive concept.
Figure 2B:
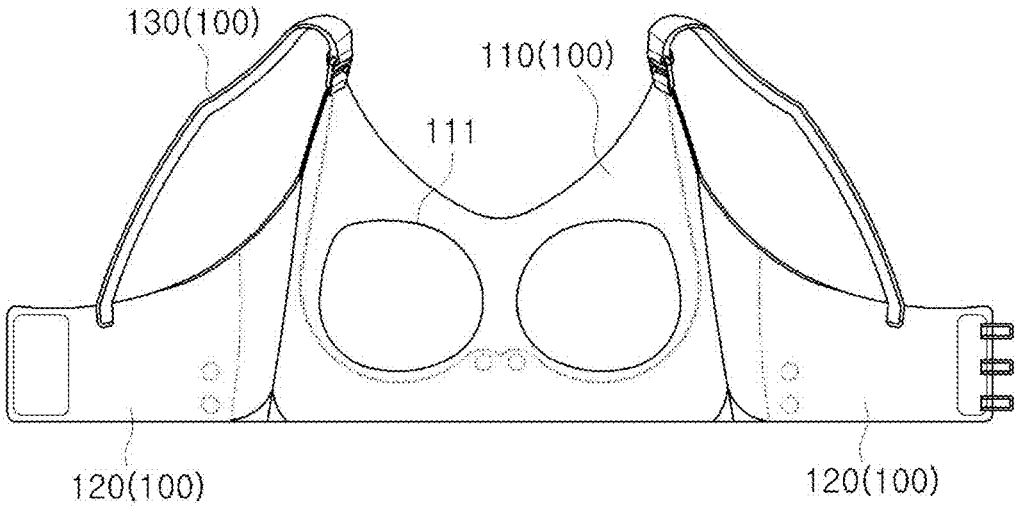
Figure 3:
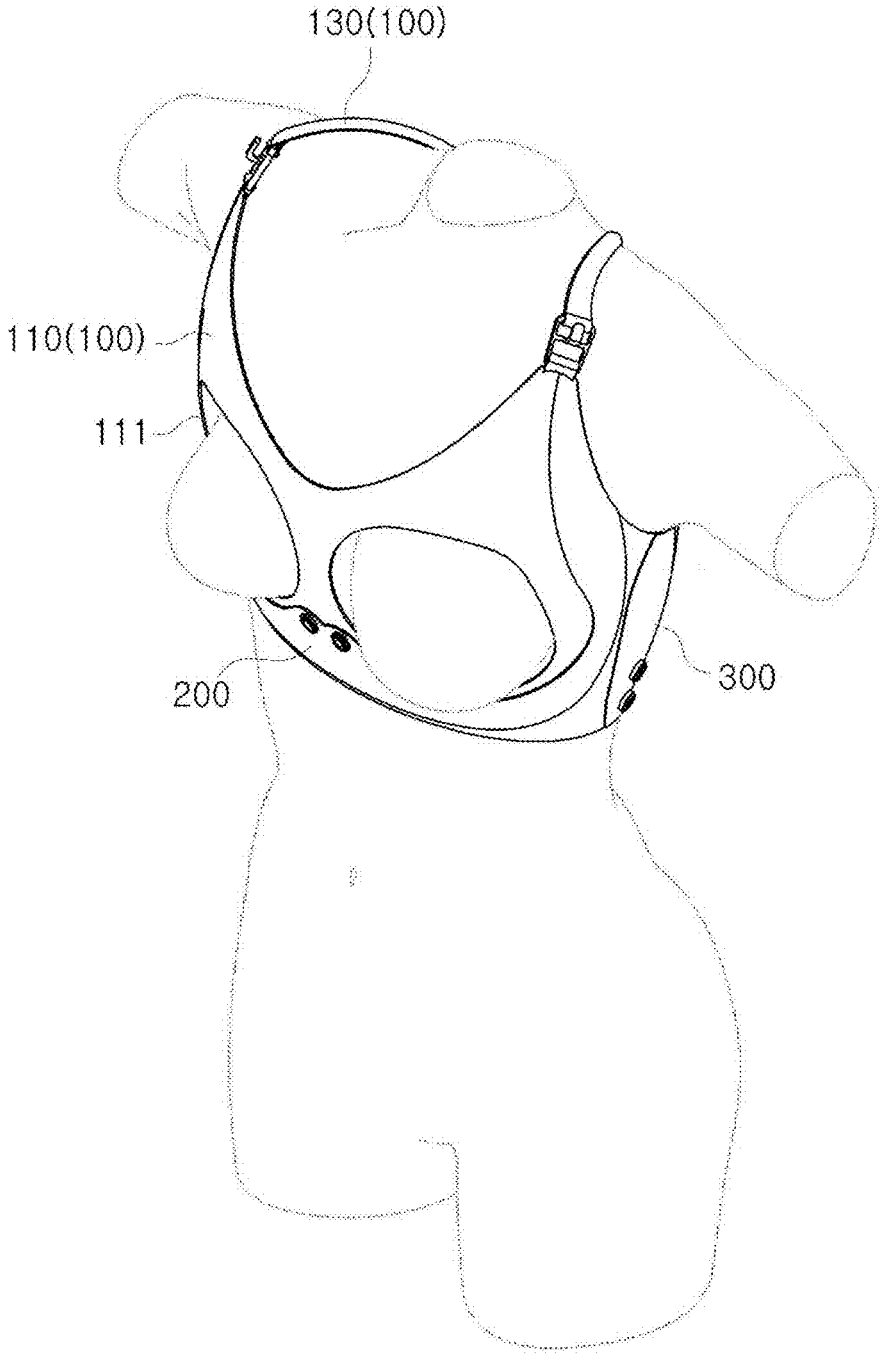
FIG. 3 is a perspective view illustrating a state in which a user wears the brassiere for a breast surgery patient according to the embodiment of the inventive concept.

FIG. 1 is a perspective view illustrating a brassiere for a breast surgery patient according to an embodiment of the inventive concept, FIG. 2 is a front view and a rear view illustrating the brassiere for a breast surgery patient according to the embodiment of the inventive concept, and FIG. 3 is a perspective view illustrating a state in which a user wears the brassiere for a breast surgery patient according to the embodiment of the inventive concept.

Figure 4:
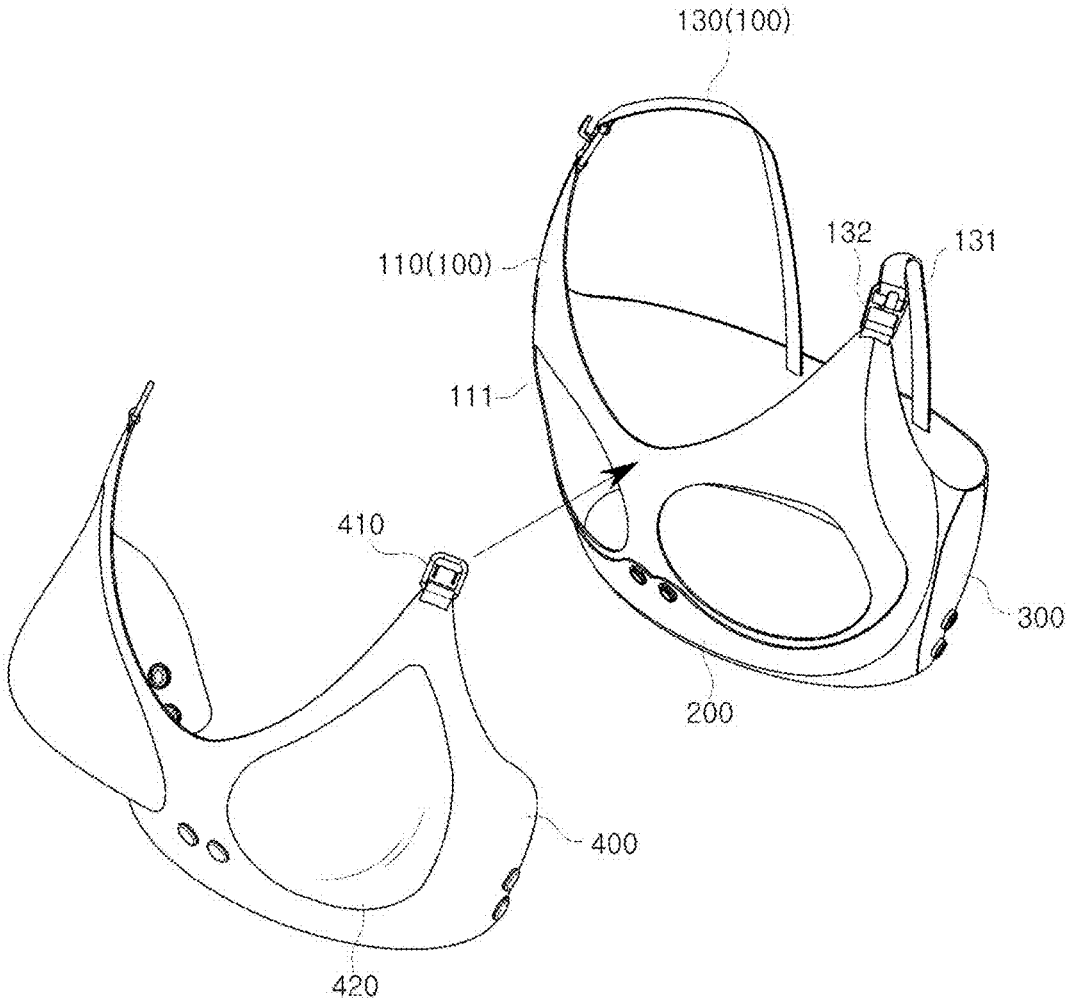
FIG. 4 is an exploded perspective view illustrating the brassiere for a breast surgery patient according to another embodiment of the inventive concept.
Figure 5:
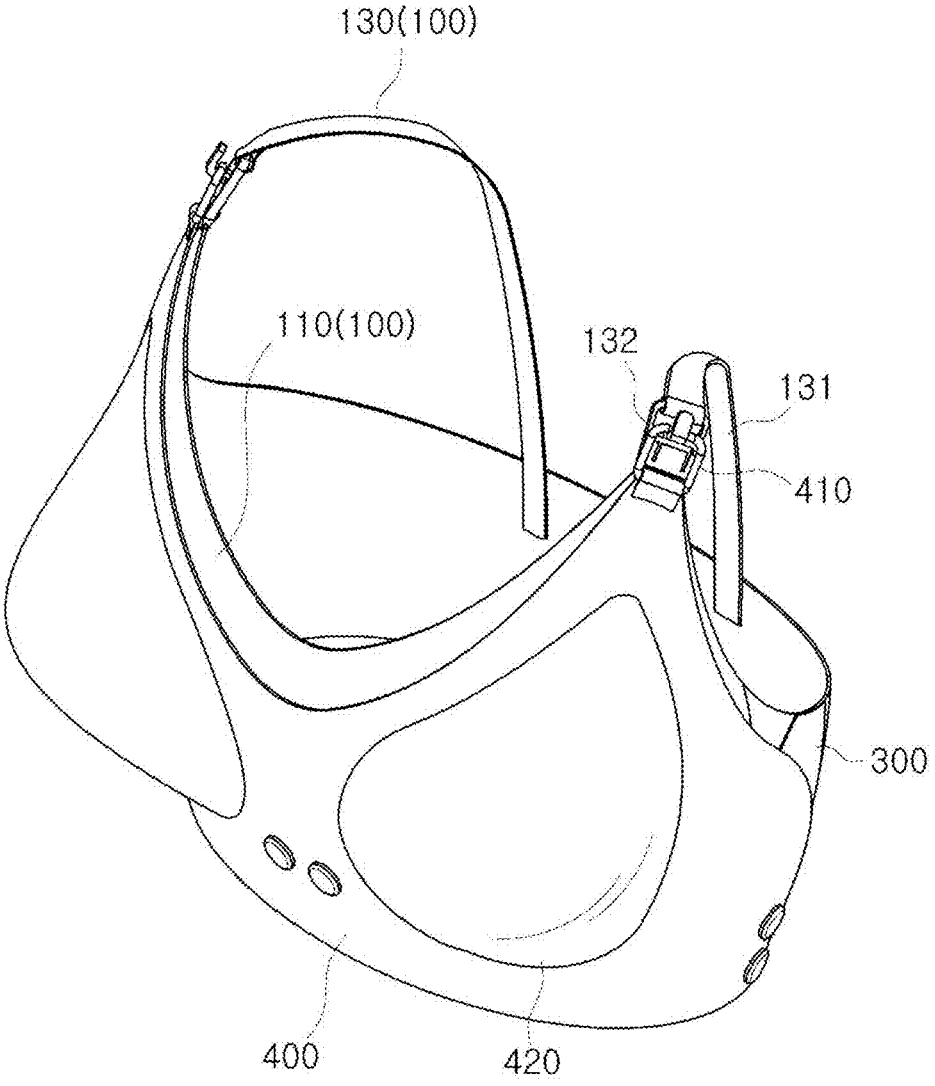
FIG. 5 is a perspective view illustrating a coupled state of the brassiere for a breast surgery patient according to another embodiment of the inventive concept.
Figure 6:
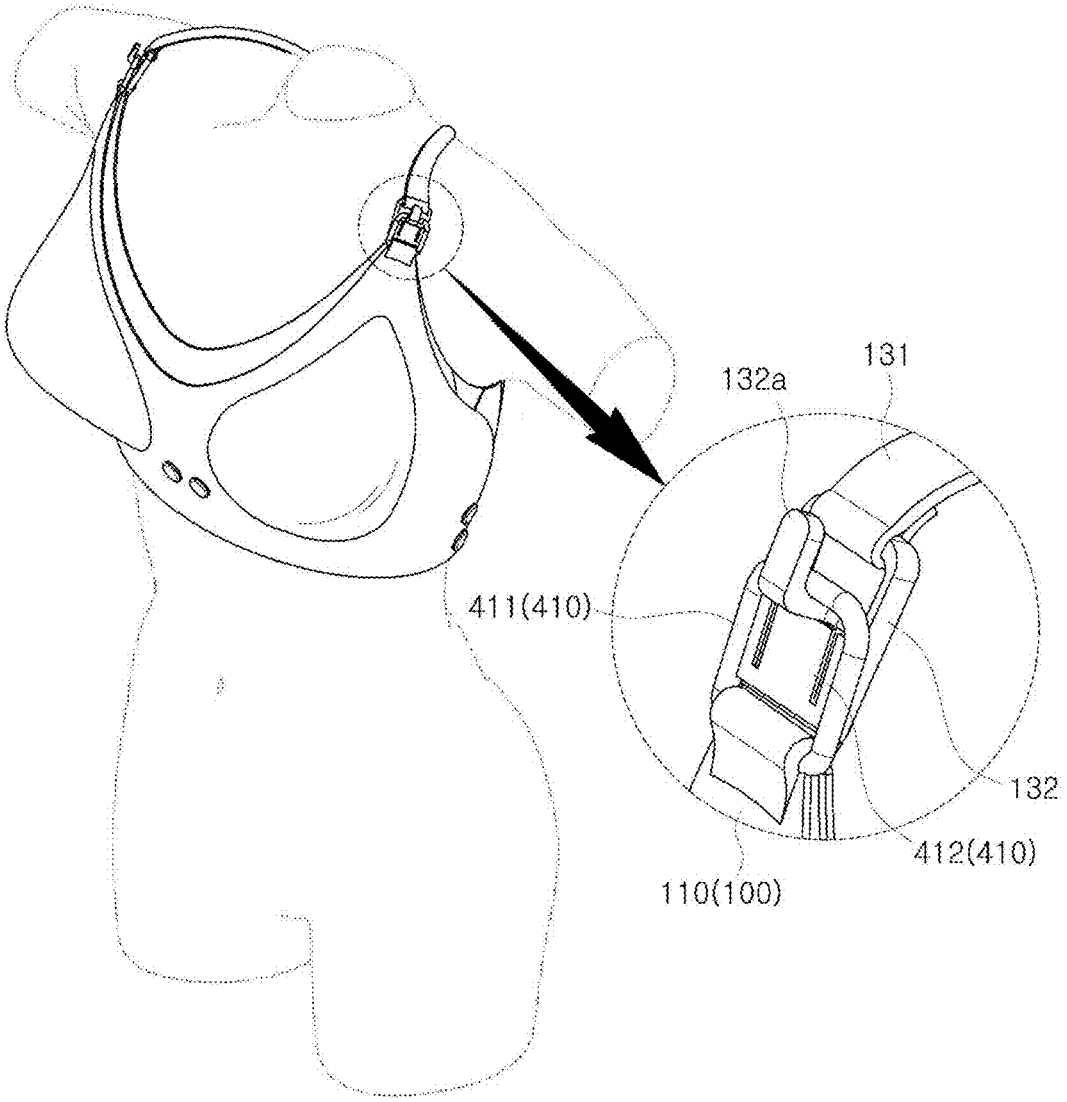
FIG. 6 is a partial enlarged view illustrating a structure in which an upper end of a cup member is fixed to the brassiere for a breast surgery patient according to another embodiment of the inventive concept.
Figure 7A:
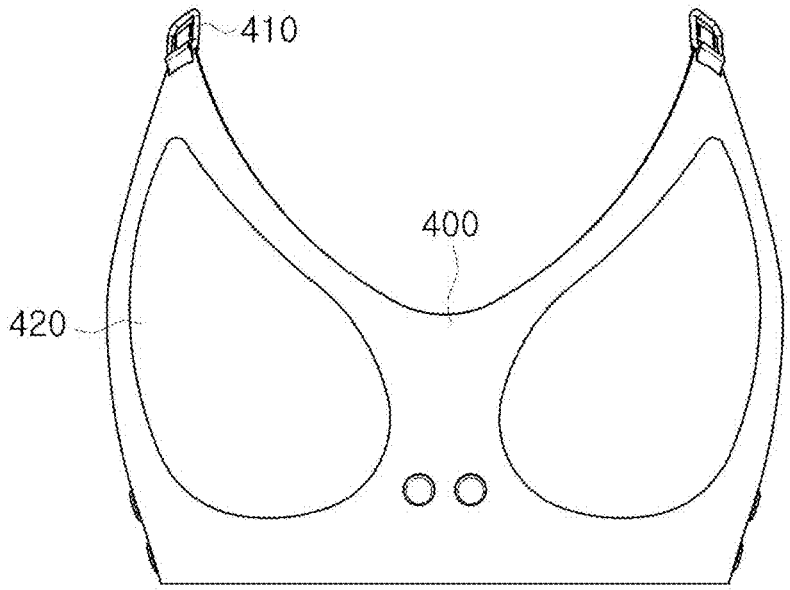
FIGS. 7A-7B are a front view and a rear view illustrating the cup member applied to the brassiere for a breast surgery patient according to another embodiment of the inventive concept.
Figure 7B:
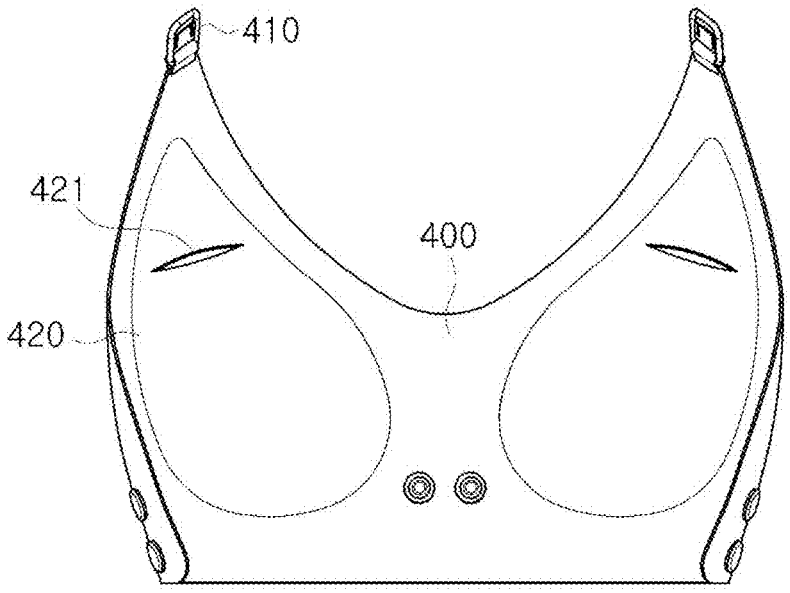
Figure 8:
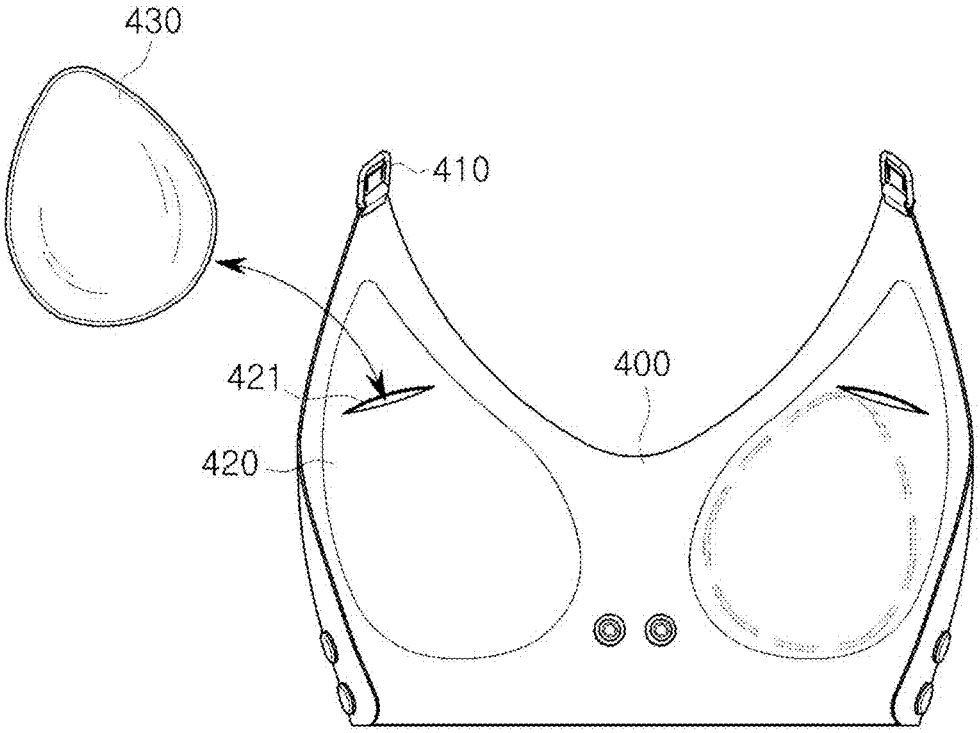
FIG. 8 is a rear view illustrating a state in which a cup pad is inserted into or extracted from an inside of a cup of the cup member applied to the brassiere for a breast surgery patient according to another embodiment of the inventive concept.
Figure 9A:
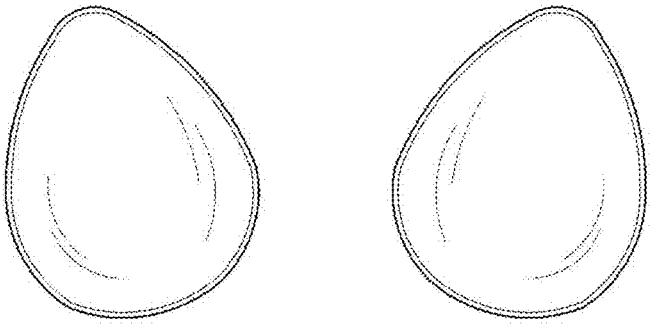
FIGS. 9A-9C are rear views illustrating examples of the cup pad applied to the brassiere for a breast surgery patient according to another embodiment of the inventive concept.
Figure 9B:
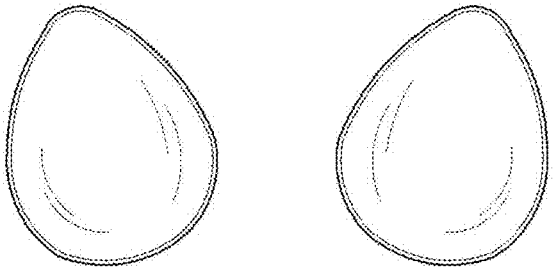
Figure 9C:
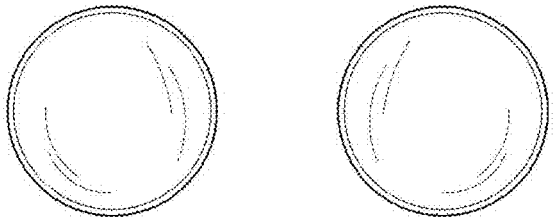

FIG. 4 is an exploded perspective view illustrating the brassiere for a breast surgery patient according to another embodiment of the inventive concept, FIG. 5 is a perspective view illustrating a coupled state of the brassiere for a breast surgery patient according to another embodiment of the inventive concept, FIG. 6 is a partial enlarged view illustrating a structure in which an upper end of a cup member is fixed to the brassiere for a breast surgery patient according to another embodiment of the inventive concept, FIG. 7 is a front view and a rear view illustrating the cup member applied to the brassiere for a breast surgery patient according to another embodiment of the inventive concept, FIG. 8 is a rear view illustrating a state in which a cup pad is inserted into or extracted from an inside of a cup of the cup member applied to the brassiere for a breast surgery patient according to another embodiment of the inventive concept, and FIG. 9 is a rear view illustrating examples of the cup pad applied to the brassiere for a breast surgery patient according to another embodiment of the inventive concept.

A brassiere for a breast surgery patient according to an embodiment of the inventive concept includes a brassiere body 100 worn on a chest part of a user and a main reinforcing band 200 coupled to the brassiere body 100, and the user in the embodiment of the inventive concept is a user who undergoes a breast surgery, but the inventive concept is not necessarily limited thereto.

As illustrated in FIGS. 1 to 3, the brassiere body 100 has a similar shape to a conventional brassiere, has a structure without cup parts covering the breasts of the user, and has a pair of breast holes 111 through which the breasts of the user pass due to the absence of the cup parts. It is preferable that the breast holes 111 be formed to have a size and a shape capable of passing through the entire breasts and surrounding outer lines of the breasts adjacent to each other, and as an example, the breast holes 111 may be formed in a circular shape having a diameter that is 0.5 cm to 1 cm larger than that of the outer lines of the breasts. Thus, when the user wears the brassiere body 100, the operated breasts pass through the breast holes 111 and are exposed to the outside of the brassiere body 100. and thus the breasts are not compressed by the brassiere body 100.

As an example, as illustrated in FIGS. 1 to 3, the brassiere body 100 may include a front close contact part 110, a rear fastening part 120, and a shoulder strap member 130.

The front close contact part 110 has the pair of breast holes 111 formed therein, covers the chest part of the user, and extends upward from an upper side of each of the pair of breast holes 111 toward a central portion of a shoulder of the user. The rear fastening part 120 is formed to extend from both sides of the front close contact part 110 and is configured such that ends thereof are fastened to each other at a back of the user while passing through lower sides of armpits of the user. In this case, the ends of the rear fastening part 120, which are fastened to each other, may be fastened at various points such that the user may adjust a chest size of the user or the degree of adhesion of the brassiere body 100.

The shoulder strap member 130, which connects an upper end of the front close contact part 110 and the rear fastening part 120 and is hung on the shoulder of the user, may include a shoulder strap 131 of which one end is connected to the rear fastening part 120 and the other end is located to be adjacent to the upper end of the front close contact part 110 and a fastening ring 132 which is formed in the form of an strap adjuster and in which the other end of the shoulder strap 131 is coupled to an upper portion thereof and the upper end of the front close contact part 110 is coupled to a lower portion thereof, wherein the shoulder strap 131 may be configured to adjust a length thereof to be suitable for the user.

As illustrated in FIGS. 1 to 3, the main reinforcing band 200 is formed in the form of a band and is coupled to the brassiere body 100 to pass through a lower side and an outer side adjacent to the pair of breast holes 111. As an example, in the case of a portion passing through lower sides of the pair of breast holes 111, the main reinforcing band 200 may be formed to have a width such that one edge is adjacent to the breast hole 111 and the other edge is adjacent to the lower end of the front close contact part 110, and in the case of a portion passing through an outside of the pair of breast holes 111, the main reinforcing band 200 may be formed to have the same or similar width to the portion passing through the lower sides of the pair of breast holes 111.

Further, the main reinforcing band 200, which serves to support the breasts exposed through the breast holes 111, may be coupled to the front close contact part 110 so that one end thereof is located at the upper end of the front close contact part 110 located above the one breast hole 111 and the other end thereof is located at the upper end of the front close contact part 110 located above the other breast hole 111, to more firmly support the lower sides of the breasts. That is, it is preferable that the main reinforcing band 200 be formed to form a shape similar to an upwardly open "C" shape or an "U" shape and a load applied to a lower portion of the front close contact part 110 be supported from the upper end of the front close contact part 110.

Further, as illustrated in FIG. 2A, a central portion of the main reinforcing band 200 passing through a lower side between the pair of breast holes 111 may extend upward toward a cleavage of the user. This is to support lower inner sides of the breasts passing through the breast holes 111 together by the main reinforcing band 200. Thus, the central portion of the main reinforcing band 200 may be formed to have a width greater than that of the other portion.

The main reinforcing band 200 is made of a soft material such as the same fabric as the brassiere body 100. The main reinforcing band 200 made of a soft material may not intensively compress a breast underline that is incised during the breast surgery to prevent a pain in an incision portion and may firmly support the lower sides and outer sides of the breasts exposed through the breast holes 111 to effectively prevent the prosthesis inserted into the breasts from being moved in a predetermined direction.

In addition, the brassiere for a breast surgery patient according to an embodiment of the inventive concept may further include an auxiliary reinforcing band 300 to further improve a breast supporting force by the main reinforcing band 200. Like the main reinforcing band 200, the auxiliary reinforcing band 300 may be made of a soft material such as the same fabric as the brassiere body 100, and as illustrated in FIGS. 1 to 3, the auxiliary reinforcing band 300 may be formed in a band shape and disposed vertically on and coupled to a portion of the rear fastening part 120 located below the armpits of the user in a vertical direction.

As an example, the auxiliary reinforcing band 300 may be formed to have the same or similar width to that of the main reinforcing band 200, may be provided such that one edge thereof is provided to be adjacent to an outer edge of the main reinforcing band 200 passing through the outside of the breast holes 111, and thus may prevent sagging and twisting of the main reinforcing band 200.

Meanwhile, nipples of the user wearing the brassiere body 100 become more prominent through an outer garment even when the user wears the outer garment, and pain may be caused in the breasts depending on a material or the degree of adhesion of the outer garment. Thus, the brassiere for a breast surgery patient may further include a cup member 400 capable of covering the breasts exposed through the breast holes 111 as needed by the user.

As an example, as illustrated in FIGS. 4 to 8, the cup member 400 may be formed to cover the breasts passing through the pair of breast holes 111 and the front close contact part 110 together. As a detailed example, the cup member 400 may be formed such that an edge thereof does not deviate from the brassiere body 100, may have a shape corresponding to or similar to the front close contact part 110, and may be formed such that both sides thereof may cover the rear fastening part 120 adjacent to the front close contact part 110.

As illustrated in FIG. 8, the cup member 400 may include a cup 420 covering the breast of the user and a cup pad 430 provided inside the cup 420. It is preferable that, while the cup 420 is formed, a cut line 421, through which the cup pad 430 may be inserted or extracted, be formed on an inner side of the outer garment, which is in contact with the breast of the user, and the cut line 421 be formed to have a length shorter than a maximum length of the cup 420 at an upper portion of the inner side of the outer garment of the cup 420. Therefore, the user may insert or extract the cup pad 430 through the cut line 421 of the cup 420 as needed.

Further, as illustrated in FIG. 9, the cup pad 430 according to the embodiment of the inventive concept may be provided as a plurality of cup pads 430 having different sizes and shapes, and thus the user may select any one of the plurality of cup pads 430 and insert the selected one cup pad 430 into the cup 420. That is, the user may select and use the cup pad 430 suitable for the user according to swelling or pain after surgery.

As illustrated in FIGS. 4 to 6, an upper end, a lower central portion, and both lower edges of the cup member 400 may be coupled to the brassiere body 100, the main reinforcing band 200, and the auxiliary reinforcing band 300 to maintain a stably coupled state through minimum coupling. That is, the upper end of the cup member 400 may be detachably coupled to a vicinity of the upper end of the front close contact part 110, the lower central portion of the cup member 400 may be detachably coupled to the main reinforcing band 200, and both edges of the cup member 400 may be detachably coupled to the auxiliary reinforcing band 300.

In this case, it is preferable that all the upper end, the lower central portion, and both edges of the cup member 400 may be coupled in a one-touch manner, but for rapid coupling and improvement of a coupling force, the upper end of the cup member 400 be coupled in a locking manner, and the lower central portion and both edges of the cup member 400 be coupled in a one-touch manner.

In an embodiment in which the upper end of the cup member 400 is coupled to the brassiere body 100 in a locking manner, as illustrated in FIG. 6, a locking protrusion 132*a* may protrude from a central portion of the fastening ring 132 of the shoulder strap member 130, which is adjacent to the upper end of the front close contact part 110, and a fixing ring 410 which is locked into the locking protrusion 132*a* may be provided at an upper end of the cup member 400. For example, when viewed from the side, the locking protrusion 132*a* may be formed in an inverted "L" shape and may protrude forward from the central portion of the fastening ring 132 in the form of an strap adjuster, and the fixing ring 410 may formed in a ring shape and lower locking may be achieved when the fixing ring 410 is locked by the locking protrusion 132*a*.

Further, the fixing ring 410 may include a fixing ring portion 411 and a movement restricting portion 412 to prevent the fixing ring 410 locked by the locking protrusion 132*a* from being unintentionally separated upward due to movement of the user. That is, the fixing ring 410 may include the fixing ring portion 411 in the form of a quadrangular ring and the movement restricting portion 412 which is formed in a plate shape having a vertical length smaller than a vertical length of the fixing ring portion 411 and in which both ends are coupled to an inside of the fixing ring portion 411 so that a locking hole through which the locking protrusion 132*a* passes is formed on an upper side thereof. Accordingly, when the locking protrusion 132*a* passes through the locking hole of the fixing ring 410, an upper end of the movement restricting portion 412 is adjacent to the locking protrusion 132*a*, and thus even when there is movement of the user, the fixing ring 410 may not easily pass through a bent portion of the locking protrusion 132*a*.

In this way, in order to minimize interference due to the locking protrusion 132*a* when the fixing ring 410 that maintains stable coupling to the locking protrusion 132*a* is to be separated from the locking protrusion 132*a*, both sides of the movement restricting portion 412 may be cut by a predetermined length from an upper end to a lower side such that the movement restricting portion 412 has a width at least corresponding to a left-right width of the locking protrusion 132*a*, and thus a variable portion may be formed. The variable portion may be bent due to contact with the locking protrusion 132*a* as the fixing ring 410 passes through the bent portion of the locking protrusion 132*a*, and then may elastically return to its original position.

As described above, the lower central portion of the cup member 400 and the main reinforcing band 200 may be coupled in a one-touch manner, and both lower edges of the cup member 400 and the auxiliary reinforcing band 300 may also be coupled in a one-touch manner. Here, the one-touch manner may be a coupling method using a tick button or a Velcro faster, and it is more preferable to adopt a coupling method through a tick button for quick coupling. In this case, the main reinforcing band 200 and the auxiliary reinforcing band 300 coupled to the brassiere body 100 serve to have a sufficient fabric thickness when the tick button is fixed.

Thus, when the user wearing the brassiere body 100 wants to couple the cup member 400, the user may hang the fixing ring 410 on the locking protrusion 132*a* to first fix the upper end of the cup member 400, then may couple the lower central portion and both lower edges of the cup member 400 to the central portion of the main reinforcing band 200 and the auxiliary reinforcing band 300, and may quickly and conveniently couple the cup member 400.

According to the inventive concept, since a lower side and an outer side of a breast passing through a breast hole are supported by a main reinforcing band made of a soft material, a breast underline incised during breast surgery is not intensively compressed, and thus pain in an incision portion may be prevented, and a random movement of a prosthesis inserted into the breast may be effectively prevented.

Further, according to the inventive concept, a cup member that may cover a breast exposed through a breast hole according to the needs of a user may be coupled to protect the breast from an outer garment when the user goes out to prevent pain and prevent prominent nipples through the outer garment.

Although the exemplary embodiments of the inventive concept have been described with reference to the accompanying drawings, it will be understood by those skilled in the art to which the inventive concept pertains that the inventive concept can be carried out in other detailed forms without changing the technical spirits and essential features thereof. Therefore, the above-described embodiments are exemplary in all aspects, and should be construed not to be restrictive.

What is claimed is:

1. A brassiere for a breast surgery patient, the brassiere comprising: a brassiere body (100) in which a pair of breast holes (111) are formed, wherein the brassiere body (100) is configured to be worn to cover a chest part of the breast surgery patient, and the pair of breast holes (111) are configured to be passed through by breasts of the breast surgery patient; a main reinforcing band (200) coupled to the brassiere body (100) to pass through a lower side and an outer side adjacent to the breast holes (111); an auxiliary reinforcing band (300) made of a soft material, formed in a band shape, and disposed vertically on and coupled to a portion of a rear fastening part (120) configured to be located on a lower side of an armpit of the breast surgery patient; and a cup member (400) configured to cover the breasts passing through the pair of breast holes (111) and a front close contact part (110) together, wherein the brassiere body (100) includes: the front close contact part (110) in which the pair of breast holes (111) are formed, wherein the front close contact part is configured to extend upward from an upper side of each of the pair of breast holes (111) to a central portion of a shoulder of the breast surgery patient while covering the chest part of the breast surgery patient; the rear fastening part (120) which extends to both sides of the front close contact part (110) and is configured to pass through the lower side of the armpit of the breast surgery patient, wherein ends of the rear fastening part (120) are configured to be fastened to each other at a back of the breast surgery patient; and a shoulder strap member (130) that connects an upper end of the front close contact part (110) and the rear fastening part (120) and is configured to be hung on the shoulder of the breast surgery patient, wherein the main reinforcing band (200) is made of a soft material and formed in a band shape, a central portion of the main reinforcing band (200) is passing through a lower side between the pair of breast holes (111) and is configured to extend upward toward a cleavage of the breast surgery patient, and the main reinforcing band (200) is coupled to the front close contact part (110) such that one end thereof is located at the upper end of the front close contact part (110) located above the one breast hole (111) and the other end thereof is located at the upper end of the front close contact part (110) located above the other breast hole (111), and wherein the cup member (400) has an upper end detachably coupled to a vicinity of the upper end of the front close contact part (110), a lower central portion detachably coupled to the main reinforcing band (200), and both lower edges detachably coupled to the auxiliary reinforcing band (300); wherein the cup member (400) includes a cup (420) configured to cover the breast of the breast surgery patient and a cup pad (430) provided inside the cup (420), wherein, while the cup (420) is formed, a cut line (421), through which the cup pad (430) is inserted or extracted, is formed on an inner side of an outer garment, which is configured to be in contact with the breast of the breast surgery patient, and wherein the cup pad (430) is provided as a plurality of cup pads (430) having different sizes and shapes, and the user selects any one of the plurality of cup pads (430) is configured to be selected by the breast surgery patient into the cup (420).

2. The brassiere of claim 1, wherein the shoulder strap member (130) includes a shoulder strap (131) of which one end is connected to the rear fastening part (120) and the other end is located in a vicinity of the upper end of the front close contact part (110) and a fastening ring (132) which is formed in form of an strap adjuster and in which the other end of the shoulder strap (131) is coupled to an upper portion thereof and the upper end of the front close contact part (110) is coupled to a lower portion thereof, wherein, when viewed from the side, a locking protrusion (132*a*) formed in an inverted "L" shape protrudes from a central portion of the fastening ring (132), and wherein the cup member (400) is provided with a fixing ring (410) locked by the locking protrusion (132*a*) at an upper end thereof.

3. The brassiere of claim 2, wherein the fixing ring (410) includes a fixing ring portion (411) in form of a quadrangular ring and a movement restricting portion (412) which is formed in a plate shape having a vertical length smaller than a vertical length of the fixing ring portion (411) and in which both ends are coupled to an inside of the fixing ring portion (411) so that a locking protrusion through which the locking protrusion (132*a*) passes is formed on an upper side thereof.

4. The brassiere of claim 1, wherein the coupling between the lower central portion of the cup member (400) and the main reinforcing band (200) and the coupling between both lower edges of the cup member (400) and the auxiliary reinforcing band (300) are achieved in a one-touch manner.

* * * * *